US005264988A

United States Patent [19]

Masaki

[11] Patent Number: 5,264,988

[45] Date of Patent: Nov. 23, 1993

[54] CIRCUIT TO LIMIT SURGES INTO A DC-OPERATED LAMP

[75] Inventor: Kazumi Masaki, Osaka, Japan

[73] Assignee: Ken Hayashibara, Okayama, Japan

[21] Appl. No.: 997,121

[22] Filed: Dec. 24, 1992

Related U.S. Application Data

[63] Continuation of Ser. No. 532,141, Jun. 4, 1990, which is a continuation of Ser. No. 296,378, Jan. 9, 1989, abandoned, which is a continuation of Ser. No. 19,187, Feb. 25, 1987, abandoned.

[30] Foreign Application Priority Data

Jul. 19, 1986 [JP] Japan ..... 61-111257

[51] Int. Cl.[5] ..... H01H 9/00

[52] U.S. Cl. ..... 361/10; 361/111

[58] Field of Search ..... 361/3-13, 361/54-58, 87, 91, 111, 88, 78, 100

[56] References Cited

U.S. PATENT DOCUMENTS

| | | | |
|---|---|---|---|
| 3,122,694 | 2/1964 | Muchnick et al. | 361/18 X |
| 3,555,361 | 1/1971 | Hallberg | 361/111 X |
| 3,835,367 | 9/1974 | Wiley | 361/111 X |
| 3,873,905 | 3/1975 | Marek | 361/56 X |
| 3,911,324 | 10/1975 | Bishop | 361/18 |
| 3,935,511 | 1/1976 | Boulanger et al. | 361/111 X |
| 3,935,527 | 1/1976 | Michelet et al. | 321/11 |
| 4,008,416 | 2/1977 | Nakasone | 323/68 X |
| 4,016,461 | 4/1977 | Roland | 361/18 |
| 4,054,831 | 10/1977 | Nercessian | 361/18 X |
| 4,389,695 | 6/1983 | Carpenter, Jr. | 361/56 X |
| 4,437,133 | 3/1984 | Rueckert | 361/111 X |
| 4,491,903 | 1/1985 | Montague | 361/111 X |
| 4,566,052 | 1/1986 | Kammiller | 361/56 X |
| 4,858,054 | 8/1989 | Franklin | 361/57 |

FOREIGN PATENT DOCUMENTS

| | | | |
|---|---|---|---|
| 3543573 | 12/1986 | Fed. Rep. of Germany . | |
| 51-31040 | 1/1976 | Japan . | |
| 51459 | 3/1985 | Japan | 361/111 |

*Primary Examiner*—Jonathan Wysocki

*Attorney, Agent, or Firm*—Browdy and Neimark

[57] ABSTRACT

A circuit to limit surges into dc-illuminated lamp, including a rectifier circuit having a smoothing means, an output terminal of the rectifier circuit being connected with a lamp; an inductor connected with an input terminal of the rectifier circuit: a surge-limiting means connected in series with its lamp: and a switching means having the main current path connected in parallel with the surge-limiting means, said switching means becoming conductive when the filament of the lamp is warmed up.

7 Claims, 1 Drawing Sheet

CIRCUIT TO LIMIT SURGES INTO A DC-OPERATED LAMP

This application is a continuation of Ser. No. 07/532,141 filed Jun. 4, 1990, which in turn is a continuation of Ser. No. 07/532,141 field Jun. 4, 1990, abandoned; which itself is a continuation of Ser. No. 07/019,187 filed Feb. 25, 1987, now abandoned.

BACKGROUND OF THE INVENTION

1. Field of the Invention

The present invention relates to a circuit to limit surges into a dc-operated lamp, for example, initial switch-on surge and arc discharge current.

2. Description of the Prior Art

Conventional starter circuits are effective in limitation of initial switch-on surge into lamp, but ineffective in limitation of an arc that may arise on burnout of filament. The arc discharges in a short-circuit manner, and continuously flows a surge of 200 amperes when, for example, a 60 watt lamp is operated with dc 130 volts. The surge may cause serious damage to circuit elements such as a rectifier and switching means.

SUMMARY OF THE INVENTION

In view of the foregoing, the main object of the present invention is to provide circuit arrangements effective in limitation of both initial switch-on surge and arc discharge current.

This and other objects as may become apparent hereinafter have been attained with the circuit comprising a rectifier circuit having a smoothing means, a output terminal of the rectifier circuit being connected with a lamp: an inductor, connected with an input terminal of the rectifier circuit, for limitation of surges into the lamp; a surge-limiting means connected in series with the lamp: and a switching means having the main current path connected in parallel with the surge-limiting means, said switching means becoming conductive when the filament of the lamp is warmed up.

DESCRIPTION OF THE PREFERRED EMBODIMENT

The present invention will hereinafter be explained with reference to the accompanying drawings in which.

Figure 1:
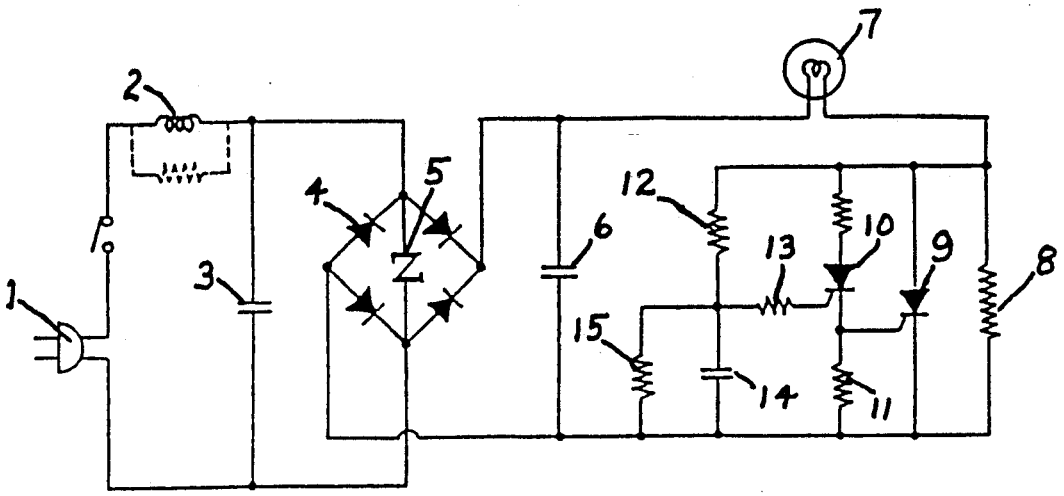
FIG. 1 is the circuit of an embodiment according to the invention.

In the embodiment as shown in FIG. 1, the input terminal of rectifier bridge (4) is to be connected with ac source (1) through inductor (2), while the output of the rectifier bridge is smoothed with capacitor (6) and then supplied to lamp (7) through resistor (8) used as the surge-limiting means. Since the filament resistance of lamp (7) is about ten ohms at ambient temperature, energization of dc 130 volts thereto flows an initial switch-on surge of 13 amperes that may burn out the filament. By providing 100 ohm resistor (8) in series to lamp (7) give a total resistance of 110 ohms, the surge is reduced to about 1.2 amperes. Thus, the outage of lamp (7) is extremely decreased.

Resistor (8) is connected in parallel with a main current path of a switching means, such as a thyristor (10), that is arranged to become conductive when the filament of lamp (7) is warmed up over a period of a prescribed time. The switching means short-circuits resistor (8) to supply the full output of the rectifier circuit to lamp (7) soon after the filament attains an incandescent state. In this embodiment, thyristor (9) is cascaded to thyristor (10) to form the switching means, and the gate of thyristor (10) is connected through resistor (13) with the time constant circuit consisting of resistor (12) and capacitor (14). By using such cascade, thyristor (9) is triggered with a relatively small current. This is very advantageous to stabilize the operation of the whole circuit. Immediately after the ac source (1) becomes on, the voltage across resistor (8) charges capacitor (14) through resistor (12) connected in parallel with resistor (8). Since, in the embodiment, the voltage across resistor (8) is used to drive the switching means, no special source is required therefor. This is very advantageous to simplify the whole circuit and stabilize its operation. Capacitor (14) is arranged to discharge through resistor (13) in accordance with the time constant as determined together with resistor (12) to the gate of thyristor (10) to trigger it. Immediately after it occurs, the voltage across resistor (11) triggers in turn thyristor (9), and it short-circuits resistor (8) to supply the full output of the rectifier circuit to lamp (7). Thus, by setting the time constant to a length sufficient to warm up the filament, the initial switch-on surge thereinto is effectively limited.

Voltage regulator diode (5) and capacitor (3), both provided in shunt to the input terminal of rectifier bridge (4), are to absorb any pulsatile voltage that may arise at its ac side. These elements are used alone or in combination.

Figure 2:
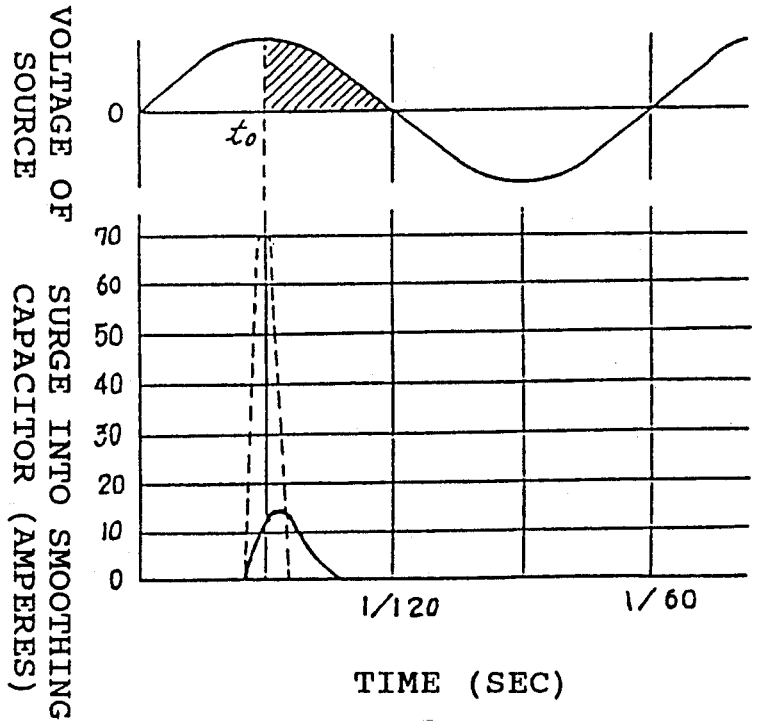
FIG. 2 is illustrative of an initial switch-on surge flowing into smoothing means soon after an ac source is connected at the time of its peak value.

The rectifier circuit including the smoothing capacitor (6) receives an initial switch-on surge having a relatively large magnitude. The magnitude of an initial switch-on surge that may arise when the ac source is connected at its peak voltage varies with capacitor (6). When its capacitance is very large, the magnitude is calculated by dividing the voltage by the internal resistance of rectifier bridge (4). FIG. 2 is illustrative of an initial switch-on surge that flows into capacitor (6) soon after the ac source (1) is connected at the time of its positive peak t0. In the embodiment, the inductor (2) provided in series to the input terminal of rectifier bridge (4) effectively limits, as well as this initial switch-on surge, an arc discharge current that may arise when the filament is burned out.

Since smoothing capacitor (6) is usually an electrolytic capacitor having a relatively large capacitance, the surge may reach several ten to several hundred amperes when inductor (2) is omitted. Now supposing that inductor (2) is six millihenries, it exerts an impedance of only 2.26 ohms against 60 hertz ac, but modifies the current across it almost into a square wave comprising a higher harmonic because the ac source (1) is at its positive peak at this moment. Further supposing that the frequency of the harmonic is 250 hertz, inductor (2) exerts an impedance of 9.4 ohms against the harmonic to limit initial switch-on surge to about 15 amperes (=140 volts/9.4 ohms) as shown in FIG. 2 with the solid line. This value is consistent with that as practically observed.

Now supposing that lamp (7) is burned out during its use, an arc discharge current of up to 200 amperes may flow into lamp (7). This may cause a serious damage to the rectifier and switching means. By using six millihenries of inductor (2), the current across rectifier bridge (4) is suppressed to amperes (=100 volts/2.26 ohms)

that is ¼ to 1/5 of that observed without using inductor (2). Because of this, the use of smoothing or switching means having an unnecessarily high capacity can be omitted according to the invention.

Inductor (2) is a core type- or a coreless typeinductor having an inductance sufficient to limit the surges into lamp (7) when used in the input circuit of the rectifier circuit including smoothing capacitor (6). The core type inductor may be, for example, a wound iron core type- or a stacked iron core type-inductor. The inductance is set to a level where the resonance circuit formed together with capacitor (6) advances the phase shift between the voltage and current compounds of higher harmonic(s) in a surge, in other words, decreases the effective power of the harmonics. By employing an inductor having a relatively low dc resistance as inductor (2), the surges including initial switch-on surges and arc discharge current are effectively limited without generating an appreciable heat by inductor (2).

In addition to limitation of initial switch-on surges, the present invention is effective in prevention of an arc that may arise and continue when the filament is burned out. The present invention is arranged to speedily and automatically limit the arc, so that damage of the rectifier and switching means is avoided. If an arc arises, the inductor kills it, and no arc flashes after the filament gap is extended. If the power switch is on when the arc disappears, the arc is never restored due to the filament having been snapped.

As described above, the present invention is characterized in that a lamp is safely dc-operated without cares for surges such as initial switch-on surge and arc discharge current, as well as that the lives of circuit elements including the lamp are extremely prolonged.

While the described embodiment represent the prefer red form of the present invention, it is to be understood that modifications will occur to those skilled in the art without departing from the spirit of the invention. The scope of the invention is therefore to be determined solely by the appended claims.

I claim:

1. A circuit to limit surges which occur in a dc-operated lamp circuit consisting essentially of:

a lamp;

a rectifier having an input terminal connected with an ac source;

a smoothing means connected with an output terminal of said rectifier;

an inductor connected with an input terminal of said rectifier, said inductor forming with said smoothing means a resonant circuit which decreases and effective power of an arc discharge current which occurs when a filament of said lamp burns out, said arc discharge current comprising harmonics the frequency is over two-fold of that of the ac source;

a surge-limiting means connected in series with said lamp and with said lamp in parallel with said smoothing means and also with an output terminal of the rectifier; and switching means having a main current path thereof connected in parallel with the surge-limiting means, said switching means comprising a first thyristor having a relatively small power capacity and a second thyristor having a relatively large power capacity which are cascaded with each other in such a manner that said first thyristor can trigger said second thyristor to allow it to short-circuit said surge-limiting means when a filament of said lamp is warmed up.

2. The circuit of claim 1, wherein at least one of a capacitor and a voltage regulator diode is connected at one end thereof with said input terminal of the rectifier circuit.

3. The circuit of claim 1, wherein said surge-limiting means is a resistive circuit.

4. The device of claim 1, wherein said inductor is a core type inductor.

5. A circuit to limit surges which occur in a dc-operated lamp circuit comprising:

a lamp;

a rectifier having an input terminal connected with an ac source;

a smoothing means connected with an output terminal of said rectifier;

an inductor connected with an input terminal of said rectifier, said inductor forming with said smoothing means a resonant circuit which decreases and effective power of an arc discharge current which occurs when a filament of said lamp burns out;

a surge-limiting means connected in series with said lamp and with said lamp in parallel with said smoothing means and also with an output terminal of the rectifier; and switching means having a main current path thereof connected in parallel with the surge-limiting means, said switching means comprising a first thyristor connected in series with a resistor means with said resistor means and said first thyristor connected in parallel with said surge-limiting means, said thyristors cascaded with each other in such a manner that said first thyristor can trigger said second thyristor with a relatively small current to allow it to short-circuit said surge-limiting means when a filament of said lamp is warmed up.

6. The circuit of claim 5, wherein said circuit constitutes means for suppressing arc discharge current to a fractional portion of its value across said rectifier, and said smoothing means is a low capacity. smoothing means.

7. The circuit of claim 5 wherein said resonant circuit constitutes means for advancing a phase shift between voltage and current elements of said effective power of an arc discharge current.

* * * * *